US011504679B2

(12) United States Patent
Asano

(10) Patent No.: US 11,504,679 B2
(45) Date of Patent: Nov. 22, 2022

(54) GAS-LIQUID MIXING DEVICE

(71) Applicant: Mtec Co., LTD., Aichi (JP)

(72) Inventor: Fumio Asano, Aichi (JP)

(73) Assignee: MTEC CO., LTD., Aichi (JP)

( * ) Notice: Subject to any disclaimer, the term of this patent is extended or adjusted under 35 U.S.C. 154(b) by 67 days.

(21) Appl. No.: 17/333,996

(22) Filed: May 28, 2021

(65) Prior Publication Data

US 2021/0379544 A1 Dec. 9, 2021

(30) Foreign Application Priority Data

Jun. 8, 2020 (JP) ..... JP2020-99644

(51) Int. Cl.
*B01F 3/04* (2006.01)
*B01F 25/312* (2022.01)
(Continued)

(52) U.S. Cl.
CPC ..... *B01F 25/3121* (2022.01); *B01F 23/232* (2022.01); *B01F 25/4523* (2022.01);
(Continued)

(58) Field of Classification Search
CPC ..... B01F 23/232; B01F 25/3121; B01F 25/312532; B01F 25/312533; B01F 25/4523; B01F 2101/24; B01F 2101/48
(Continued)

(56) References Cited

U.S. PATENT DOCUMENTS 5,514,267 A * 5/1996 Machiya ..... C02F 1/24 261/36.1
9,061,256 B2 6/2015 Mori
(Continued)

FOREIGN PATENT DOCUMENTS

EP 0 009 854 4/1980
JP 55-048055 4/1980
(Continued)

OTHER PUBLICATIONS

Official Action issued in Japanese Counterpart Patent Appl. No. 2020-169312, dated Nov. 24, 2020, along with an English translation thereof.

*Primary Examiner* — Charles S Bushey
(74) *Attorney, Agent, or Firm* — Greenblum & Bernstein, P.L.C.

(57) ABSTRACT

The device is a gas-liquid mixing device having a venturi structure in which a throat portion and an enlarged diameter portion are provided in a main passage through which a liquid passes, the gas-liquid mixing device including a collision chamber provided on an outer periphery of the enlarged diameter portion, and a stirring chamber provided downstream of the enlarged diameter portion. A collision flow path communicating with the collision chamber and causing a gas-liquid to collide with an outer peripheral wall, a straight flow path through which the gas-liquid passing through a central portion of the enlarged diameter portion travels straight, and an outer ring flow path through which the gas-liquid flows from the collision chamber to the stirring chamber are formed downstream of the enlarged diameter portion. The gas-liquids from the outer ring flow path and the straight flow path are stirred in the stirring chamber.

6 Claims, 5 Drawing Sheets

(51) Int. Cl.

| | |
|---|---|
| ***B01F 23/232*** | (2022.01) |
| ***B01F 25/452*** | (2022.01) |
| *B01F 101/24* | (2022.01) |
| *B01F 101/48* | (2022.01) |

(52) U.S. Cl.
CPC ... *B01F 25/312533* (2022.01); *B01F 2101/24* (2022.01); *B01F 2101/48* (2022.01)

(58) Field of Classification Search
USPC ..... 261/76, DIG. 75
See application file for complete search history.

(56) References Cited

U.S. PATENT DOCUMENTS

| | | | | |
|---|---|---|---|---|
| 9,308,504 | B2 * | 4/2016 | Lai | B01F 23/23 |
| 10,695,726 | B2 | 6/2020 | Tian et al. | |
| 2007/0095937 | A1 * | 5/2007 | Noguchi | B01F 25/3121 239/290 |
| 2013/0214436 | A1 | 8/2013 | Mori | |
| 2017/0215428 | A1 * | 8/2017 | Takahashi | B01F 25/3121 |
| 2017/0304782 | A1 * | 10/2017 | Wu | B01F 25/31242 |
| 2019/0330829 | A1 * | 10/2019 | Juan | B01F 25/31243 |
| 2020/0038815 | A1 | 2/2020 | Tian et al. | |

FOREIGN PATENT DOCUMENTS

| | | |
|---|---|---|
| JP | 11-090954 | 4/1999 |
| JP | 2009-233532 | 10/2009 |
| JP | 3169936 | 8/2011 |
| JP | 2016-196238 | 11/2016 |
| JP | 2020-15013 | 1/2020 |
| JP | 2020-18996 | 2/2020 |

* cited by examiner

GAS-LIQUID MIXING DEVICE

CROSS REFERENCE TO RELATED APPLICATIONS

The present application claims priority under 35 U.S.C. § 119 of Japanese Application No. 2020-099644 filed on Jun. 8, 2020, the disclosure of which is expressly incorporated by reference herein in its entirety.

BACKGROUND OF THE INVENTION

(1) Field of the Invention

The present invention relates to a gas-liquid mixing device, and more particularly to a gas-liquid mixing device that generates microbubbles.

(2) Description of Related Art

Microbubbles have various properties such as low floating speed in liquid and solubility of dissolving gas into liquid with high efficiency. Additionally, since the bubbles are negatively charged and do not bond with each other, the bubbles have a washing property of adsorbing and floating a positively charged substance such as dirt. Further, an effect of sterilizability by self-collapsing can be expected.

As a technique for generating microbubbles, there is a method using a venturi structure in which the cross-sectional area of a passage through which a liquid flows is reduced to reduce pressure, a gas from outside air is mixed, and an enlarged diameter portion with an increased cross-sectional area is provided downstream, so that shear stress due to the pressure change is generated in a gas-liquid mixed with the gas to fragment the gas.

Further, as a technique for crushing large bubbles, according to JP 2020-15013 A, in a gas-liquid flow path, an upstream first collision portion and a downstream second collision portion are provided with respect to a traveling direction of the gas-liquid, and the gas-liquid is caused to collide with the collision portions to crush and fragment large bubbles.

As a technique for taking in an external gas, according to JP 2020-18996 A, a gap between screw connection surfaces of a water supply pipe and a housing of a gas-liquid mixing device is communicated with a space provided inside the gas-liquid mixing device at a negative pressure area created by reducing the cross-sectional area of a flow passage, to take in the external gas without providing an intake hole.

Additionally, according to JP 3169936 Y, a screw is provided as an intake adjustment tool in a lateral hole of a throat portion where a cross-sectional area of a flow passage is reduced, and an external gas is taken in by using a screwing clearance between a female screw and a male screw which is a minute play generated by advancing the screw.

In the technique described in JP 2020-15013 A, in a case where the cross section of the main passage where the downstream second collision portion is provided is smaller than the cross section of the main passage where the upstream first collision portion is provided, the flow rate is decreased, and the gas-liquid does not collide efficiently. Hence, at the cross sections where the collision portions are provided, the more downstream the collision portion is provided, the larger the area through which the gas-liquid passes relative to the area of the collision portion, and the lower the collision rate becomes. As described above, although the bubbles that collide are fragmented, there are some large bubbles that do not collide, and uniform microbubbles are not formed.

In the technique described in JP 2020-18996, when the screw is tightened, inclined surfaces of the threads of the female screw and the male screw on one side are brought into close contact, and the space between the female screw and the male screw is a clearance between the inclined surfaces of the threads on the side not in close contact. Hence, the path to outside air is formed only in the screw advancing direction, and the distance is long. As a result, the amount of intake air varies depending on the processing accuracy of the effective diameter, the root diameter, the surface roughness, and the like of each of the female screw and the male screw in the space.

In the technique described in JP 3169936 Y, there is a problem that when used in the loosened state, the screw as an intake adjustment tool may be loosened and unfastened by vibration.

SUMMARY OF THE INVENTION

Embodiments of the present invention solve the above problems, and an object thereof is to provide a gas-liquid mixing device capable of efficiently and stably generating microbubbles.

The gist of the present embodiment is a gas-liquid mixing device having a venturi structure in which a throat portion and an enlarged diameter portion connected to a downstream side of the throat portion and increasing in diameter toward the downstream side are provided in a main passage through which a liquid passes, the gas-liquid mixing device including a ring-shaped collision chamber provided on an outer peripheral side of the enlarged diameter portion, and a stirring chamber provided on a downstream side of the enlarged diameter portion, in which a flow path on the downstream side of the enlarged diameter portion includes: a collision flow path that is connected to the collision chamber and causes a gas-liquid to collide with an outer peripheral wall of the collision chamber; a straight flow path that is connected to the stirring chamber and through which the gas-liquid passing through a central portion of the enlarged diameter portion travels straight; and an outer ring flow path through which the gas-liquid flows from the collision chamber to the stirring chamber, and the gas-liquid from the outer ring flow path and the gas-liquid from the straight flow path are stirred in the stirring chamber.

The gist of another embodiment may be that a plurality of collision flow paths are arranged at equal angular intervals around a central axis of the enlarged diameter portion, the plurality of collision flow paths being formed in the same shape, and a plurality of outer ring flow paths are arranged at equal angular intervals around the central axis of the enlarged diameter portion, the plurality of outer ring flow paths being formed in the same shape.

The gist of another embodiment may be that the straight flow path is formed on the same axis as the throat portion, and a cross section of the straight flow path is formed larger than a cross section of the throat portion.

The gist of another embodiment may be that: the gas-liquid mixing device is connectable to a water supply pipe by a screw; a notch is formed in a thread of the screw around an insertion direction of the screw; and the notch communicates with the throat portion or the enlarged diameter portion in order to supply an external gas to the inside.

A gist of another embodiment may be that a wire mesh filter that fragments bubbles is provided at an outlet of the stirring chamber.

According to the gas-liquid mixing device of the present embodiment, the inside of the gas-liquid mixing device has a venturi structure in which a throat portion and an enlarged diameter portion connected to the downstream side of the throat portion and expanding in diameter toward the downstream side are provided in a main passage through which a liquid passes. Hence, the liquid flowing through the main passage is depressurized by the throat portion in which the cross-sectional area of the flow passage is reduced. Shear stress due to pressure change is generated in the liquid by the enlarged diameter portion provided downstream and increasing the cross-sectional area, whereby the gas in the passed liquid is fragmented.

Further, a ring-shaped collision chamber is provided on the outer peripheral side of the enlarged diameter portion, and a stirring chamber is provided on the downstream side of the enlarged diameter portion. A flow path on the downstream side of the enlarged diameter portion includes a collision flow path that connects to the collision chamber and causes a gas-liquid to collide with an outer peripheral wall of the collision chamber, a straight flow path that connects to the stirring chamber and through which the gas-liquid passing through a central portion of the enlarged diameter portion travels straight, and an outer ring flow path through which the gas-liquid flows from the collision chamber to the stirring chamber. The gas-liquid from the outer ring flow path and the gas-liquid from the straight flow path are stirred in the stirring chamber. As a result, the liquid having passed through the enlarged diameter portion is bifurcated into the collision flow path communicating with the collision chamber and the straight flow path communicating with the stirring chamber. The colliding gas-liquid having passed through the collision flow path collides with the outer peripheral wall of the collision chamber, and the bubbles are crushed. Additionally, the straight gas-liquid from the straight flow path is stirred with the outer ring gas-liquid having passed through the outer ring flow path in the stirring chamber, whereby the bubbles are fragmented.

Additionally, assume that a plurality of collision flow paths and a plurality of outer ring flow paths are arranged at equal angle intervals around the central axis of the enlarged diameter portion, the plurality of collision flow paths are formed in the same shape, and the plurality of outer ring flow paths are formed in the same shape. In this case, the gas-liquid flowing through the enlarged diameter portion from the throat portion can flow to the collision flow path and the straight flow path without being disturbed, and can effectively collide with the outer peripheral wall of the collision chamber.

Additionally, the straight flow path is formed on the same axis as the throat portion, and in a case where the cross section of the straight flow path is formed to be larger than the cross section of the throat portion, gas-liquid around the center of the throat portion having a high flow rate not receiving resistance of the inner wall of the throat portion is allowed to flow as straight gas-liquid without receiving resistance of the inner wall of the enlarged diameter portion. In the stirring chamber, the straight gas-liquid having a relatively high flow rate and the outer ring gas-liquid having a low flow rate due to repeated collision come into contact with each other and generate a rotating vortex in the contact area. Thus, the gas-liquids repeatedly collide with each other, and the bubbles can be fragmented.

Additionally, assume that the gas-liquid mixing device is connectable to a water supply pipe by a screw, a notch is formed in a thread of the screw around an insertion direction of the screw, and the notch communicates with the throat portion or the enlarged diameter portion in order to supply an external gas to the inside. In this case, even if the screw is tightened, an external gas flow path can be formed in a cross section around the insertion direction of the screw, and the gas passing through the screw portion can be supplied from outside air in the insertion direction of the screw. Hence, it is possible to curb variations in the amount of intake air depending on the processing accuracy of the effective diameter, the root diameter, the surface roughness, and the like of each of the female screw and the male screw.

Additionally, in a case where a wire mesh filter that fragments bubbles is provided at the outlet of the stirring chamber, by applying an appropriate resistance to the straight gas-liquid, it is possible to generate a gas-liquid that travels straight and passes through the wire mesh filter and a blocked gas-liquid that is blocked by the wire mesh filter and flows to the outside. The blocked gas-liquid collides with the outer ring gas-liquid to fragment bubbles, and passes through the wire mesh filter with the outer ring gas-liquid. Uniform small holes are formed in the wire mesh filter, and the bubbles can be turned into uniform microbubbles by passing through the small holes.

Note that according to the gas-liquid mixing device of the reference mode, the inside of the gas-liquid mixing device has a venturi structure in which a throat portion and an enlarged diameter portion connected to the downstream side of the throat portion and expanding in diameter toward the downstream side are provided in a main passage through which a liquid passes. Hence, the liquid flowing through the main passage is depressurized by the throat portion in which the cross-sectional area of the flow passage is reduced. Shear stress due to pressure change is generated in the liquid by the enlarged diameter portion provided downstream and increasing the cross-sectional area, whereby the gas in the passed liquid is fragmented.

Further, the gas-liquid mixing device is connectable to a water supply pipe by a screw, a notch is formed in a thread of the screw around an insertion direction of the screw, and the notch communicates with the throat portion or the enlarged diameter portion in order to supply an external gas to the inside. As a result, even when the screw is tightened, the external gas flow path can be formed in the cross section around the insertion direction of the screw, and the gas passing through the screw portion can be supplied from outside air in the insertion direction of the screw. Hence, it is possible to curb variations in the amount of intake air depending on the processing accuracy of the effective diameter, the root diameter, the surface roughness, and the like of each of the female screw and the male screw.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Gas-Liquid Mixing Device

Figure 1:
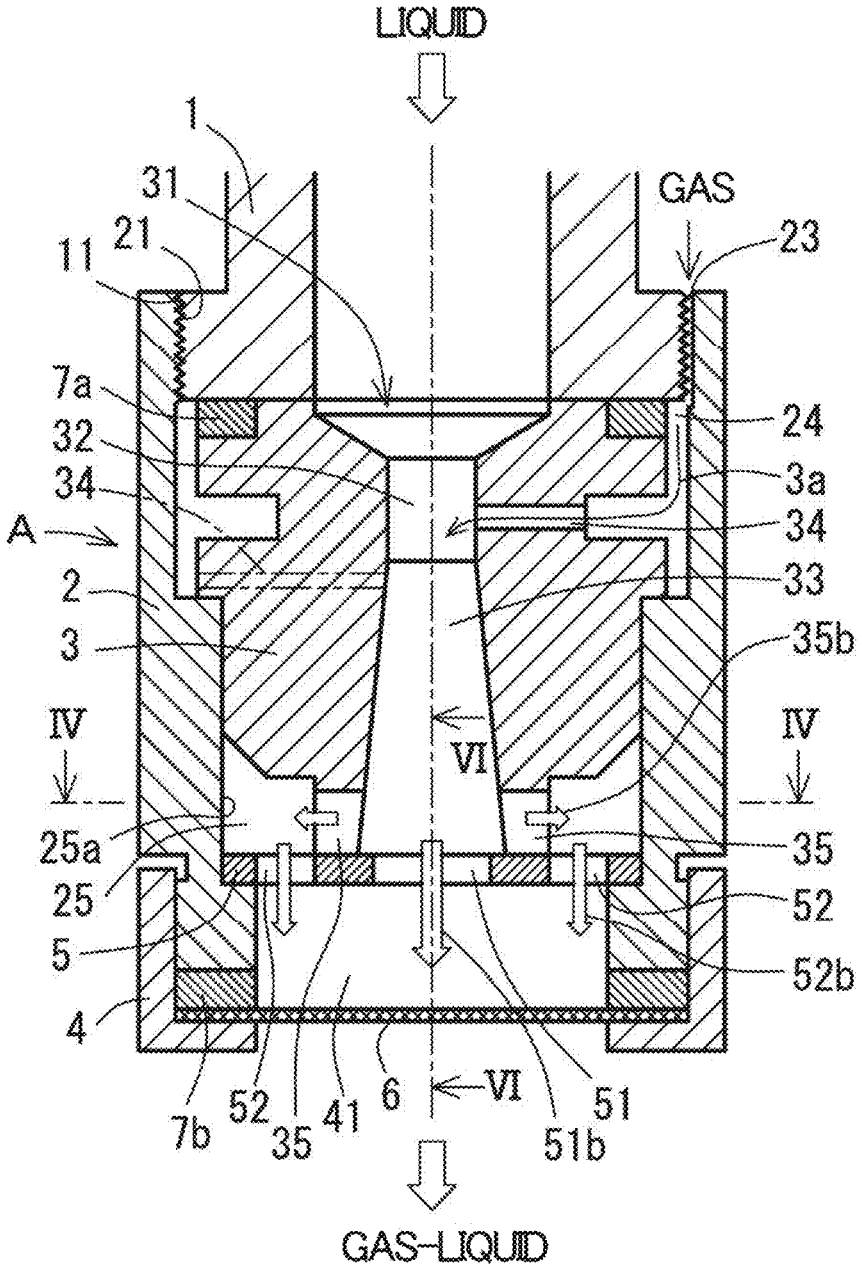
FIG. 1 is a longitudinal sectional view of a gas-liquid mixing device according to an example.

A gas-liquid mixing device according to the present embodiment is, for example, as shown in FIG. 1 and other drawings, a gas-liquid mixing device (A) having a venturi structure in which a throat portion (32) and an enlarged diameter portion (33) connected to a downstream side of the throat portion (32) and expanding in diameter toward the downstream side are provided in a main passage (31) through which a liquid passes. Hence, the liquid flowing through the main passage (31) is depressurized by the throat portion (32) in which the cross-sectional area of the flow passage is reduced. Shear stress due to pressure change is generated in the liquid by the enlarged diameter portion (33) provided downstream and increasing the cross-sectional area, whereby the gas in the passed liquid is fragmented.

Further, a ring-shaped collision chamber (25) is provided on the outer peripheral side of the enlarged diameter portion (33), and a stirring chamber (41) is provided on the downstream side of the enlarged diameter portion (33). A flow path on the downstream side of the enlarged diameter portion (33) includes a collision flow path (35) that connects to the collision chamber (25) and causes a gas-liquid to collide with an outer peripheral wall (25*a*) of the collision chamber (25), a straight flow path (51) that connects to the stirring chamber (41) and through which the gas-liquid passing through a central portion of the enlarged diameter portion (33) travels straight, and an outer ring flow path (52) through which the gas-liquid flows from the collision chamber (25) to the stirring chamber (41). The gas-liquid (52*b*) from the outer ring flow path (52) and the gas-liquid (51*b*) from the straight flow path (51) are stirred in the stirring chamber (41). As a result, the liquid having passed through the enlarged diameter portion (33) is bifurcated into a collision flow path (35) communicating with the collision chamber (25) and a straight flow path (51) communicating with the stirring chamber (41). The colliding gas-liquid (35*b*) having passed through the collision flow path (35) collides with the outer peripheral wall (25*a*) of the collision chamber (25), and the bubbles are crushed. Additionally, the straight gas-liquid (51*b*) from the straight flow path (51) is stirred with the outer ring gas-liquid (52*b*) having passed through the outer ring flow path (52) in the stirring chamber (41), whereby the bubbles are fragmented.

The diameter and length of the throat portion (32) and the length and angle of the enlarged diameter portion (33) are appropriately selected according to the flow rate of liquid and the like. The throat portion (32) and the enlarged diameter portion (33) are usually formed on the same axis. Further, for example, an internal gas flow path (34) for supplying an external gas can be connected to the throat portion (32) or the enlarged diameter portion (33).

The shape, size, and the like of the collision chamber (25) are appropriately selected according to the flow rate of liquid and the like. The collision chamber (25) can be provided, for example, on a cross-sectional outer ring of the enlarged diameter portion (33). Further, for example, the collision chamber (25) can be formed in a ring shape so as to surround the outer periphery of the enlarged diameter portion (33).

The shape, size, and the like of the stirring chamber (41) are appropriately selected according to the flow rate of liquid and the like. The stirring chamber (41) can be provided, for example, on the downstream side of the throat portion (32) and the collision chamber (25).

The shape, size, arrangement place, number, and the like of the collision flow path (35) are appropriately selected according to the flow rate of liquid and the like. The collision flow path (35) can extend in a direction intersecting the central axis of the enlarged diameter portion (33), for example.

The shape, size, and the like of the straight flow path (51) are appropriately selected according to the flow rate of liquid and the like.

The shape, size, arrangement place, number, and the like of the outer ring flow path (52) are appropriately selected according to the flow rate of liquid and the like. The outer ring flow path (52) can be formed in, for example, an arc hole shape centered on the central axis of the enlarged diameter portion (33).

As an example of the gas-liquid mixing device according to the present embodiment, as shown in FIG. 1 and other drawings, an internal generation member (3) that generates bubbles is disposed in a housing (2) connected to a water supply pipe (1), and the internal generation member (3) has a venturi structure in which a throat portion (32) and an enlarged diameter portion (33) that is connected to a downstream side of the throat portion (32) and expands in diameter toward the downstream side are provided in a main passage (31) through which a liquid passes.

In the case of the above-described mode, for example, the collision chamber (25) can be formed between an inner peripheral surface of the housing (2) and an outer peripheral surface of the internal generation member (3). Further, for example, a partition (5) that partitions the collision chamber (25) and the stirring chamber (41) can be disposed inside the housing (2), and a straight flow path (51) and an outer ring flow path (52) can be formed in the partition (5). Further, for example, the internal generation member (3) can have an internal gas flow path (34) for supplying an external gas to the throat portion (32) or the enlarged diameter portion (33).

Figure 4:
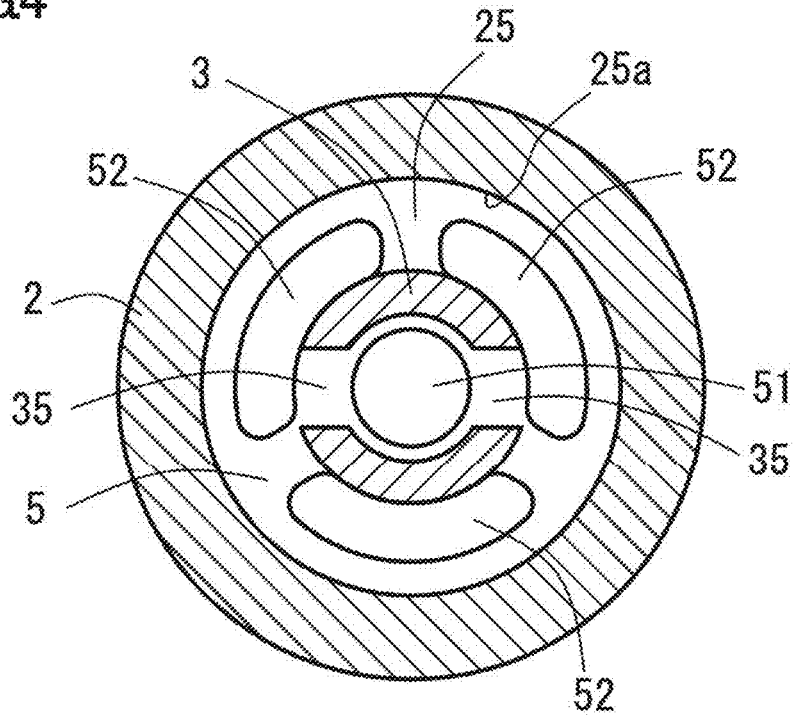
FIG. 4 is a cross-sectional view taken along line IV-IV of FIG. 1.

As the gas-liquid mixing device according to the present embodiment, for example, as shown in FIG. 4 and other drawings, a plurality of collision flow paths (35) and a plurality of outer ring flow paths (52) are arranged at equal angle intervals around the central axis of the enlarged diameter portion (33), the plurality of collision flow paths (35) are formed in the same shape (specifically, rotationally symmetric shape about central axis of enlarged diameter portion (33)), and the plurality of outer ring flow paths (52) are formed in the same shape. As a result, the gas-liquid flowing through the enlarged diameter portion (33) from the throat portion (32) can flow into the collision flow path (35) and the straight flow path (51) without being disturbed, and can effectively collide with the outer peripheral wall (25*a*) of the collision chamber (25).

As the gas-liquid mixing device according to the present embodiment, for example, as shown in FIG. 1 and other drawings, a straight flow path (51) is formed on the same axis as a throat portion (32), and a cross section of the straight flow path (51) is formed larger than a cross section of the throat portion (32). As a result, the gas-liquid flowing around the center of the throat portion (32) and having a high flow rate without receiving resistance of the inner wall of the throat portion (32) is allowed to flow as the straight gas-liquid (51*b*) without receiving resistance of the inner wall of the enlarged diameter portion (33). In the stirring chamber (41), the straight gas-liquid (51*b*) having a relatively high flow rate and the outer ring gas-liquid (52*b*) having a low flow rate due to repeated collision come into contact with each other and generate a rotating vortex (41*b*) in the contact area. Thus, the gas-liquids repeatedly collide with each other, and the bubbles can be fragmented (see FIG. 5, for example).

Figure 2:
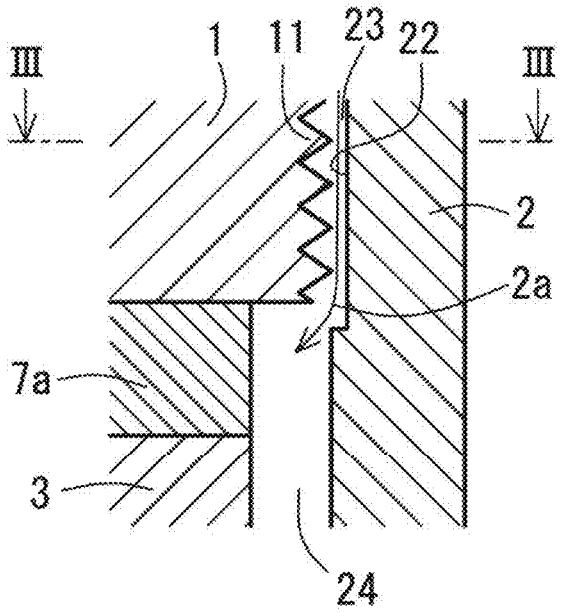
FIG. 2 is an enlarged view of a main part of FIG. 1.
Figure 3:
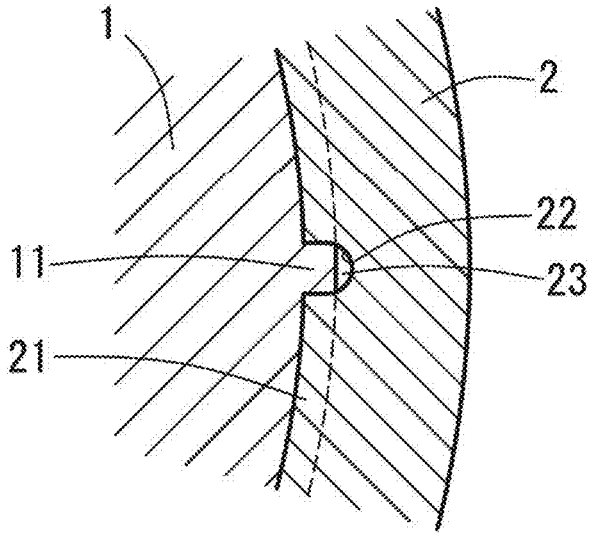
FIG. 3 is an enlarged cross-sectional view taken along line of FIG. 2.

As the gas-liquid mixing device according to the present embodiment, for example, as shown in FIGS. 1 to 3 and other drawings, a gas-liquid mixing device (A) is connectable to a water supply pipe (1) by a screw (11, 21), a notch (22) is formed in a thread of the screw (11, 21) around an insertion direction of the screw, and the notch (22) communicates with the throat portion (32) or the enlarged diameter portion (33) in order to supply an external gas to the inside. As a result, even when the screw (11, 21) is tightened, the external gas flow path (23) can be formed in the cross section (see FIG. 3, for example) around the insertion direction of the screw, and the screw portion passing gas (2*a*) can be supplied from outside air in the insertion direction of the screw. Hence, it is possible to curb variations in the amount of intake air depending on the processing accuracy of the effective diameter, the root diameter, the surface roughness, and the like of each of the female screw (21) and the male screw (11) (see FIG. 2, for example).

In the case of the above-described mode, for example, the internal generation member (3) that generates bubbles is disposed in the housing (2) connected to the water supply pipe (1) with the screw (11, 21), and the internal generation member (3) can have a venturi structure in which a throat portion (32) and an enlarged diameter portion (33) connected to the downstream side of the throat portion (32) and expanding in diameter toward the downstream side are provided in the main passage (31) through which a liquid passes.

Note that any of the water supply pipe (1) and the housing (2) may be a female screw or a male screw, and the notch (22) may be formed in any of the female screw and the male screw.

Additionally, the shape, size, arrangement location, and number of the notch (22) are appropriately selected according to the flow rate of gas and the like.

Figure 5:
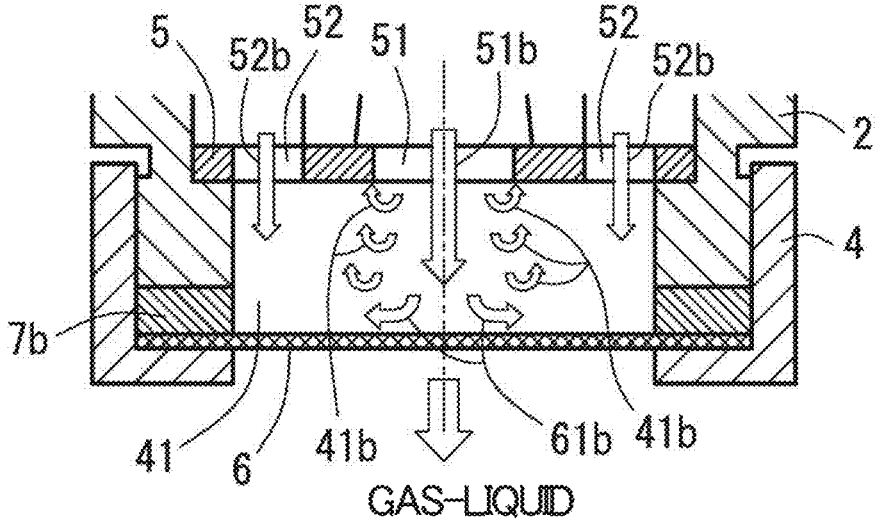
FIG. 5 is an enlarged view of a main part of FIG. 1.
Figure 6:
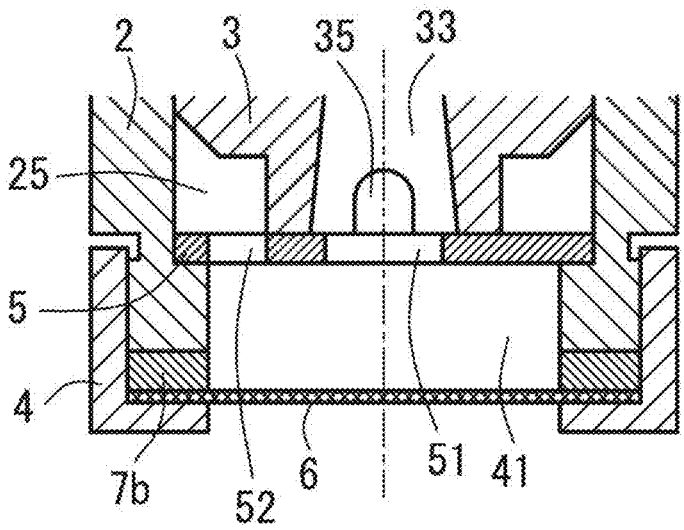
FIG. 6 is a cross-sectional view taken along line VI-VI of FIG. 1.

As the gas-liquid mixing device according to the present embodiment, for example, as shown in FIG. 5 and other drawings, a wire mesh filter (6) for fragmenting bubbles is provided at the outlet of the stirring chamber (41). As a result, by applying an appropriate resistance to the straight gas-liquid (51*b*), it is possible to generate a gas-liquid that travels straight and passes through the wire mesh filter (6) and a blocked gas-liquid (61*b*) that is blocked by the wire mesh filter (6) and flows to the outside. The blocked gas-liquid (61*b*) collides with the outer ring gas-liquid (52*b*) to fragment bubbles, and passes through the wire mesh filter (6) with the outer ring gas-liquid (52*b*). Uniform small holes are formed in the wire mesh filter (6), and the bubbles can be turned into uniform microbubbles by passing through the small holes.

Note that the small hole size of the wire mesh filter (6) is appropriately selected according to the flow rate of liquid and the like.

Other Gas-Liquid Mixing Device

Another gas-liquid mixing device according to the present embodiment is, for example, as shown in FIG. 1 and other drawings, a gas-liquid mixing device (A) having a venturi structure in which a throat portion (32) and an enlarged diameter portion (33) connected to a downstream side of the throat portion (32) and expanding in diameter toward the downstream side are provided in a main passage (31) through which a liquid passes. Hence, the liquid flowing through the main passage (31) is depressurized by the throat portion (32) in which the cross-sectional area of the flow passage is reduced. Shear stress due to pressure change is generated in the liquid by the enlarged diameter portion (33) provided downstream and increasing the cross-sectional area, whereby the gas in the passed liquid is fragmented.

Further, for example, as shown in FIGS. 1 to 3 and other drawings, a gas-liquid mixing device (A) is connectable to a water supply pipe (1) by a screw (11, 21), a notch (22) is formed in a thread of the screw (11, 21) around an insertion direction of the screw, and the notch (22) communicates with the throat portion (32) or the enlarged diameter portion (33) in order to supply an external gas to the inside. As a result, even when the screw (11, 21) is tightened, the external gas flow path (23) can be formed in the cross section (see FIG. 3, for example) around the insertion direction of the screw, and the screw portion passing gas (2*a*) can be supplied from outside air in the insertion direction of the screw. Hence, it is possible to curb variations in the amount of intake air depending on the processing accuracy of the effective diameter, the root diameter, the surface roughness, and the like of each of the female screw (21) and the male screw (11) (see FIG. 2, for example).

In the case of the above-described mode, for example, the internal generation member (3) that generates bubbles is disposed in the housing (2) connected to the water supply pipe (1) with the screw (11, 21), and the internal generation member (3) can have a venturi structure in which a throat portion (32) and an enlarged diameter portion (33) connected to the downstream side of the throat portion (32) and expanding in diameter toward the downstream side are provided in the main passage (31) through which a liquid passes.

Note that any of the water supply pipe (1) and the housing (2) may be a female screw or a male screw, and the notch (22) may be formed in any of the female screw and the male screw.

Additionally, the shape, size, arrangement location, and number of the notch (22) are appropriately selected according to the flow rate of gas and the like.

Further, as another gas-liquid mixing device according to the present embodiment, for example, one or a combination of two or more of the configurations described in the gas-liquid mixing device according to the above-described embodiment can be applied.

Note that the reference numerals in parentheses of the configurations described in the above embodiment indicate a correspondence relationship with specific configurations described in examples described later.

Example

Hereinafter, the present invention will be specifically described by way of an example with reference to the drawings.

In a gas-liquid mixing device A according to the present example, as shown in FIG. 1, a cylindrical housing 2 is screwed to a water supply pipe 1, an internal generation member 3 and a partition 5 are disposed inside the housing 2, the internal generation member 3 is press-fitted into the housing 2, and a joint portion between the water supply pipe 1 and the internal generation member 3 is water-stopped by a packing 7*a*. Additionally, a cap 4 on which a wire mesh filter 6 is disposed is connected to the housing 2 on the opposite side of the water supply pipe 1, and a joint portion between the housing 2 and the cap 4 is water-stopped by a packing 7*b*. The housing 2, the internal generation member 3, the partition 5, and the cap 4 are formed of a material such as metal or resin.

In the internal generation member 3, a venturi structure is formed in which a columnar throat portion 32 and a tapered enlarged diameter portion 33 which is connected to the downstream side of the throat portion 32 and expands in diameter toward the downstream side are provided in a main passage 31 through which a liquid passes. Hence, the liquid flowing through the main passage 31 is depressurized by the throat portion 32 in which the cross-sectional area of the flow passage is reduced. Shear stress due to pressure change is generated in the liquid by the enlarged diameter portion 33 provided downstream and increasing the cross-sectional area, whereby the gas in the passed liquid is fragmented.

The housing 2 includes a collision chamber 25 on an outer ring downstream of the enlarged diameter portion 33 and formed by recessing an outer shell of the internal generation member 3, and a stirring chamber 41 formed by the partition 5 and the cap 4. Additionally, a collision flow path 35 that is connected to the collision chamber 25 and causes the gas-liquid to collide with an outer peripheral wall 25*a* of the collision chamber 25 is cut out and formed downstream of the internal generation member 3. Further, the partition 5 has a straight flow path 51 that is connected to the stirring chamber 41 and through which a gas-liquid passing through a center portion of the enlarged diameter portion 33 travels straight. As a result, the liquid having passed through the enlarged diameter portion 33 is bifurcated into the collision flow path 35 and the straight flow path 51. The colliding gas-liquid 35*b* having passed through the collision flow path 35 is caused to collide with the outer peripheral wall 25*a* of the collision chamber 25, and the bubbles are crushed.

An outer ring flow path 52 communicating with the collision chamber 25 and the stirring chamber 41 is formed in the partition 5. Hence, the gas-liquid in the collision chamber 25 passes through the outer ring flow path 52 and flows into the stirring chamber 41 as an outer ring gas-liquid 52*b*. Additionally, a straight gas-liquid 51*b* having passed through the straight flow path 51 flows in from the enlarged diameter portion 33, and both gas-liquids 51*b* and 52*b* are stirred in the stirring chamber 41, whereby the bubbles are further fragmented.

Here, the collision chamber 25 is formed in a ring shape and communicates with all the collision flow paths 35. As shown in FIG. 4, a plurality of collision flow paths 35 and a plurality of outer ring flow paths 52 (two collision flow paths 35 and three outer ring flow paths 52 in FIG. 4) are arranged at equal angular intervals in the circumferential direction around the central axis of the enlarged diameter portion 33. The plurality of collision flow paths 35 are formed in the same shape, and the plurality of outer ring flow path 52 are formed in the same shape. As a result, the gas-liquid flowing from the throat portion 32 through the enlarged diameter portion 33 can flow into the collision flow path 35 and the straight flow path 51 without being disturbed, and the effect of causing the colliding gas-liquid 35*b* to collide with the outer peripheral wall 25*a* of the collision chamber 25 can be enhanced. Additionally, bubbles can be made uniform by contact between colliding gas-liquids 35*b* of different collision flow paths 35 in the collision chamber 25.

The straight flow path 51 is formed on the same axis as the throat portion 32, and the cross section of the straight flow path 51 is formed larger than the cross section of the throat portion 32. That is, the cross section of the straight flow path 51 orthogonal to the central axis is formed larger than the cross section of the throat portion 32 orthogonal to the central axis. As a result, the gas-liquid flowing around the center of the throat portion 32 and having a high flow rate without receiving resistance of the inner wall of the throat portion 32 is allowed to flow as the straight gas-liquid 51*b* without receiving resistance of the inner wall of the enlarged diameter portion 33. Hence, as shown in FIG. 5, in the stirring chamber 41, the straight gas-liquid 51*b* having a relatively high flow rate and the outer ring gas-liquid 52*b* having a low flow rate due to repeated collision come into contact with each other and generate a rotating vortex 41*b* in the contact area. Thus, the bubbles can be fragmented.

Note that other conditions (shape, size, arrangement location, number, and the like) of the collision flow path 35, the outer ring flow path 52, and the straight flow path 51 affect each other, and therefore can be set according to the liquid flow rate and the like.

As shown in FIGS. 2 and 3, the housing 2 has a notch 22 (i.e., notch 22 extending in insertion direction of screw) formed in the thread of a female screw 21 around the insertion direction of the screw. The notch 22 includes an external gas flow path 23 surrounded by a male screw 11 and the housing 2. Additionally, as shown in FIG. 1, an outer ring gas flow path 34 surrounded by the housing 2 and the internal generation member 3 is provided by stopping water at the water supply pipe 1 and the internal generation member 3 with the packing 7*a*. The external gas flow path 23 and the outer ring gas flow path 34 communicate with each other, and the outer ring gas flow path 34 communicates with the depressurizing throat portion 32. As a result, even when the screws 11 and 21 are tightened, the external gas flow path 23 can be formed, and a screw portion passing gas 2*a* (see FIG. 2) can be supplied from outside air in the insertion direction of the screws 11 and 21. Note that the shape, size, arrangement location, and number of the notch 22 can be set according to the flow rate of gas and the like.

In a case where the male screw 11 of the water supply pipe 1 is connected to a general tap or a screw of a shower connection pipe, the shape of the male screw 11 of the water supply pipe 1 is likely to change due to wear or deterioration, and it can be said that the shape is unfixed. Since the external gas flow path 23 is in the insertion direction of the screws 11 and 21, it is possible to curb variations in the amount of intake air depending on the processing accuracy of the effective diameter, the root diameter, the surface roughness, and the like of the screws 11 and 21 as compared with a case where gas flows in the advancing direction along the threads.

Additionally, while the water supply pipe 1 is the male screw 11 and the housing 2 is the female screw 21 in the present example, any of the male screw and the female screw may be used, and the notch 22 may be formed in any of the female screw and the male screw.

As shown in FIG. 5, by applying an appropriate resistance to the straight gas-liquid 51*b* by the wire mesh filter 6 disposed at the discharge port, not only gas-liquid simply passing through the wire mesh filter 6, but also a blocked gas-liquid 61*b* repelled by the wire mesh filter 6 and flowing to the outside can be generated. The blocked gas-liquid 61*b* collides with the outer ring gas-liquid 52*b* to fragment bubbles, and passes through the wire mesh filter 6 together with the outer ring gas-liquid 52*b*. Uniform small holes are formed in the wire mesh filter 6, and the bubbles can be turned into uniform microbubbles by passing through the small holes. Note that the small hole size of the wire mesh filter 6 is appropriately selected according to the flow rate or the like of the liquid.

Next, gas-liquid mixing tests according to an experimental example and a comparative example will be described.

Figure 7:
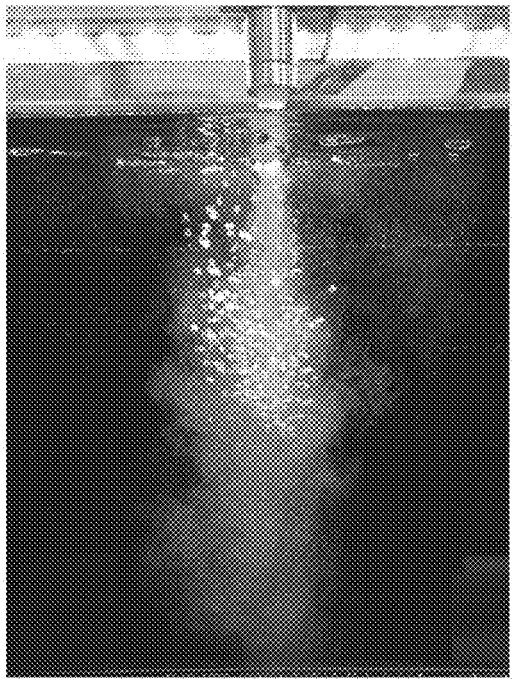
FIG. 7 is an image processing diagram showing a state of generation of microbubbles in a gas-liquid mixing test of an experimental example.
Figure 8:
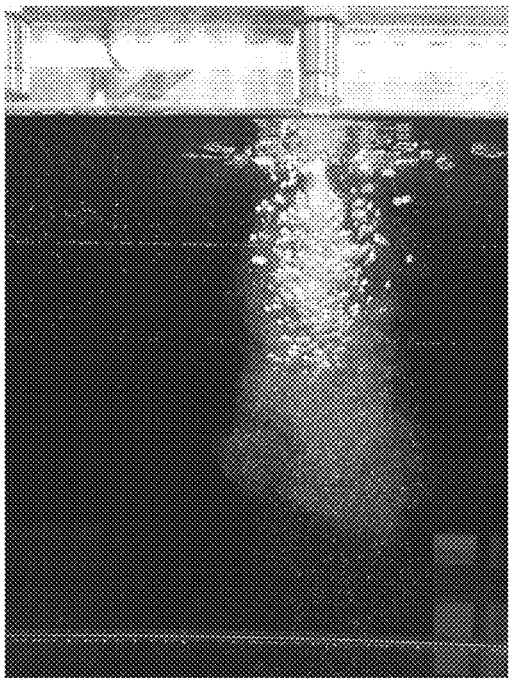
FIG. 8 is an image processing diagram showing a state of generation of microbubbles in a gas-liquid mixing test of a comparative example.

In the gas-liquid mixing test of the experimental example, a gas-liquid mixing device A according to the example was adopted, and the discharged gas-liquid were observed. On the other hand, in the gas-liquid mixing test of the comparative example, in the gas-liquid mixing device A according to the example, a venturi structure not including any of the collision chamber 25, the partition 5, and the stirring chamber 41 was adopted, and the discharged gas-liquid was observed. As a result, in the gas-liquid mixing test of the experimental example, as shown in FIG. 7, it was confirmed that a large amount of microbubbles of 0.1 mm or less was generated in the discharged gas-liquid. On the other hand, in the gas-liquid mixing test of the comparative example, as shown in FIG. 8, it was confirmed that a small amount of microbubbles of 0.1 mm or less was generated.

The gas-liquid mixing device of the present invention is not limited to the configuration of the above example, and the configuration may be changed at any time without departing from the essence of the invention of the claims.

For example, while a plurality of collision flow paths 35 and a plurality of outer ring flow paths 52 are arranged at equal angular intervals around the central axis of the enlarged diameter portion 33 in the above example, the present invention is not limited thereto. For example, a plurality of collision flow paths 35 and a plurality of outer ring flow paths 52 may be arranged at unequal angular intervals around the central axis of the enlarged diameter portion 33.

Additionally, while the straight flow path 51 has a larger cross section than the cross section of the throat portion 32 in the above example, the present invention is not limited thereto. For example, the straight flow path 51 may have a smaller cross section than the cross section of the throat portion 32.

Further, while the internal gas flow path 34 allows the notch 22 and the throat portion 32 to communicate with each other in the above example, the present invention is not limited thereto. For example, as illustrated by a virtual line in FIG. 1, the internal gas flow path 34 may allow the notch 22 and the enlarged diameter portion 33 to communicate with each other.

Additionally, while the external gas flow path 23 is formed in the screw joint portion between the water supply pipe 1 and the housing 2 in the above example, the present invention is not limited thereto. For example, the external gas flow path 23 may be formed in a portion away from the screw joint portion of the housing.

Further, while the stirring chamber 41 includes the wire mesh filter 6 in the above example, the present invention is not limited thereto. For example, the stirring chamber 41 not including the wire mesh filter 6 may be used.

The present invention is widely used as a technique related to a gas-liquid mixing device used in various fields such as degreasing and cleaning of parts, improvement of water quality in aquaculture and agriculture, cleaning at home, and bathing.

What is claimed is:

1. A gas-liquid mixing device having a venturi structure in which a throat portion and an enlarged diameter portion connected to a downstream side of the throat portion and increasing in diameter toward the downstream side are provided in a main passage through which a liquid passes, the gas-liquid mixing device comprising:

a ring-shaped collision chamber provided on an outer peripheral side of the enlarged diameter portion, and;

a stirring chamber provided on a downstream side of the enlarged diameter portion, wherein a flow path on the downstream side of the enlarged diameter portion includes: a collision flow path that is connected to the collision chamber and causes a gas-liquid to collide with an outer peripheral wall of the collision chamber; a straight flow path that is connected to the stirring chamber and through which the gas-liquid passing through a central portion of the enlarged diameter portion travels straight; and an outer ring flow path through which the gas-liquid flows from the collision chamber to the stirring chamber, and the gas-liquid from the outer ring flow path and the gas-liquid from the straight flow path are stirred in the stirring chamber.

2. The gas-liquid mixing device according to claim 1, wherein a plurality of the collision flow paths are arranged at equal angular intervals around a central axis of the enlarged diameter portion, the plurality of collision flow paths being formed in the same shape, and a plurality of the outer ring flow paths are arranged at equal angular intervals around the central axis of the enlarged diameter portion, the plurality of outer ring flow paths being formed in the same shape.

3. The gas-liquid mixing device according to claim 1, wherein the straight flow path is formed on the same axis as the throat portion, and a cross section of the straight flow path is formed larger than a cross section of the throat portion.

4. The gas-liquid mixing device according to claim 2, wherein the straight flow path is formed on the same axis as the throat portion, and a cross section of the straight flow path is formed larger than a cross section of the throat portion.

5. The gas-liquid mixing device according to claim 1, wherein the gas-liquid mixing device is connectable to a water supply pipe by a screw, a notch is formed in a thread of the screw around an insertion direction of the screw, and the notch communicates with the throat portion or the enlarged diameter portion in order to supply an external gas to the inside.

6. The gas-liquid mixing device according to claim 1, wherein a wire mesh filter that fragments bubbles is provided at an outlet of the stirring chamber.

* * * * *